US005470179A

United States Patent [19]

Maciel

[11] Patent Number: 5,470,179

[45] Date of Patent: Nov. 28, 1995

[54] WIDENED-BASE STRUCTURE FOR SUPPORTING AN OFFSHORE PLATFORM

[75] Inventor: Vitor G. Maciel, Rio de Janeiro, Brazil

[73] Assignee: Petroleo Brasileiro S.A. - Petrobras, Rio de Janeiro, Brazil

[21] Appl. No.: 120,766

[22] Filed: Sep. 15, 1993

[30] Foreign Application Priority Data

Sep. 16, 1992 [BR] Brazil ..... 9203617

[51] Int. Cl.[6] ..... E02R 17/00

[52] U.S. Cl. ..... 405/224; 405/195.1; 405/227

[58] Field of Search ..... 405/195.1, 224, 405/227, 204, 208

[56] References Cited

U.S. PATENT DOCUMENTS 3,729,940 5/1973 Koehler .

4,907,912 3/1990 Smith ..... 405/227 X

FOREIGN PATENT DOCUMENTS 2214548 1/1989 United Kingdom .

*Primary Examiner*—David H. Corbin

*Attorney, Agent, or Firm*—Sughrue, Mion, Zinn, Macpeak & Seas

[57] ABSTRACT

A widened base, latticed frame work structure for supporting an offshore platform includes four main legs slanting in a lower region and a transition region of the structure and extending parallel in pairs in the front and rear faces in the upper region. A pair of secondary legs aligned with the upper part of the main legs form the launch rails on which the structure can be launched from a barge. The widened base is formed by dihedral external lateral faces and main legs, the structure being fixed to the sea bottom by vertical piles attached to the lower end of the main legs.

3 Claims, 4 Drawing Sheets

WIDENED-BASE STRUCTURE FOR SUPPORTING AN OFFSHORE PLATFORM

BACKGROUND OF THE INVENTION

The present invention refers to a widened-base structure for supporting a platform for offshore operations, such as well drilling, oil and gas exploration and production, or for support or any other installations at sea, having four main legs and a widened base, endowed with dihedral external lateral faces, in which the main legs, extended by ramifications referred to as secondary legs, make up the launch rails on which the structure can be loaded out in a barge from the construction site and later launched at sea from the barge.

The most commonly employed structures for supporting offshore platforms are space frame with four or eight main legs, such space frames having a pyramidal frustum configuration, with square or rectangular base and top. The choice of a structure having either four or eight legs depends basically on the required base and top sizes as well as on the magnitude of the acting operational and environmental loads, so that when such requisites can be met for a four-legged structure, this is normally the most simple and efficient solution.

The eight-legged structures are normally installed by launching, using as launch rails two parallel internal faces of structure and showing, consequently, few elements specifically designed for the launching operation. As a drawback, they present larger structural complexity, with a larger number of structural elements to be manufactured and assembled, causing an increase in the acting environmental loads.

The four-legged structures are normally installed by lifting or launching, according to their dimensions and weight and the performance of the available naval facilities. When launched, the conventional four-legged structures require specific additional structures, such as two launch trusses or internal members for bearing and sliding, leading effectively to a six-legged structure, wherein the four main legs located at the corners of the structure are basically used to bear the operation and environmental loads while the two parallel internal legs are used only in the installation phase. These additional structures are useless and cumbersome, since they do not contribute to the overall strength and increase the dead weight and environmental loads acting on the structure.

SUMMARY OF THE INVENTION

With the aim of eliminating the above cited inconveniences, which are inherent to the conventional four or eight-legged offshore structures, there is provided, according to the present invention, a structure for supporting an offshore platform, which is distinguished by presenting four main legs, launch rails for loading out and launching, a widened base endowed with dihedral external lateral faces, a foundation system by guideless piles or a group of vertical guideless piles fixed to the main legs, and a raised lower horizontal frame.

Due to its peculiar geometrical configuration, the structure which is the object of the present invention does not present main elements specific to the installation phase but all the main elements are designed for the operation condition. Also, the structure presents relatively reduced loads in the foundations not only because of the widened base but also as a consequence of the low susceptibility to environmental loads, this being derived from its slenderness and simplicity, notably in the regions close to sea surface.

Thus the objective of the present invention is a structure for supporting an offshore platform with a high degree of optimization, minimized weight and simplified geometrical configuration, causing appreciable reduction in manufacture, assembly time and cost, besides allowing efficient transportation and installation by conventional methods.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
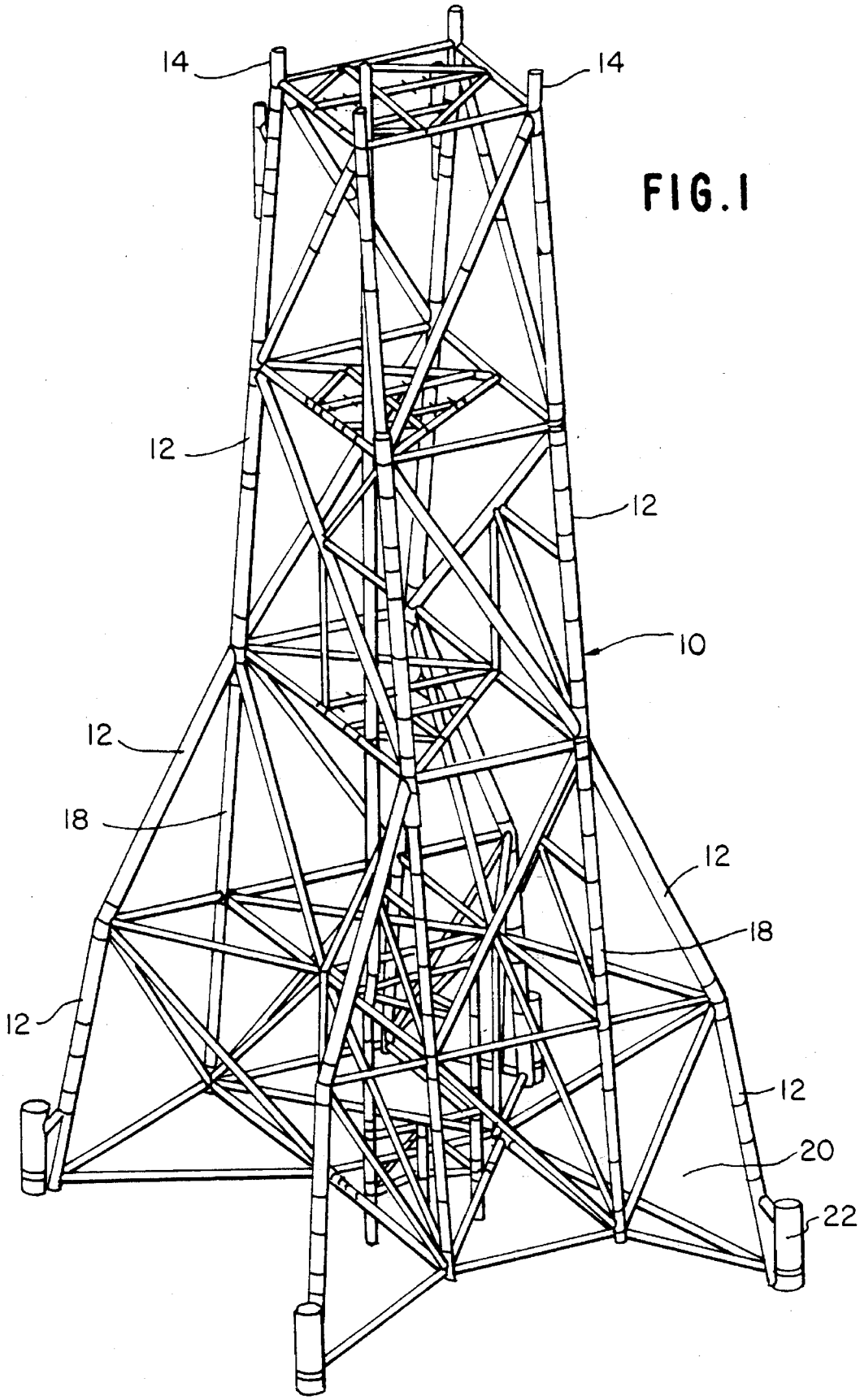
FIG. 1 is a perspective view of the structure according to the present invention.
Figure 2B:
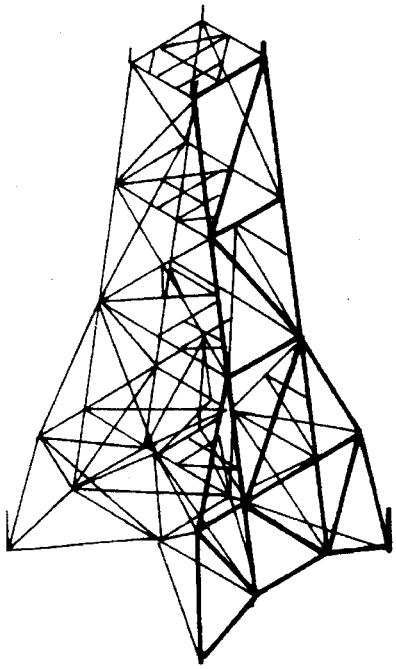
FIG. 2*b* is a schematic view of the structure wherein the thick lines of the wire frame sketch show the location of FIG. 2*a* in the structure of the invention.
Figure 2A:
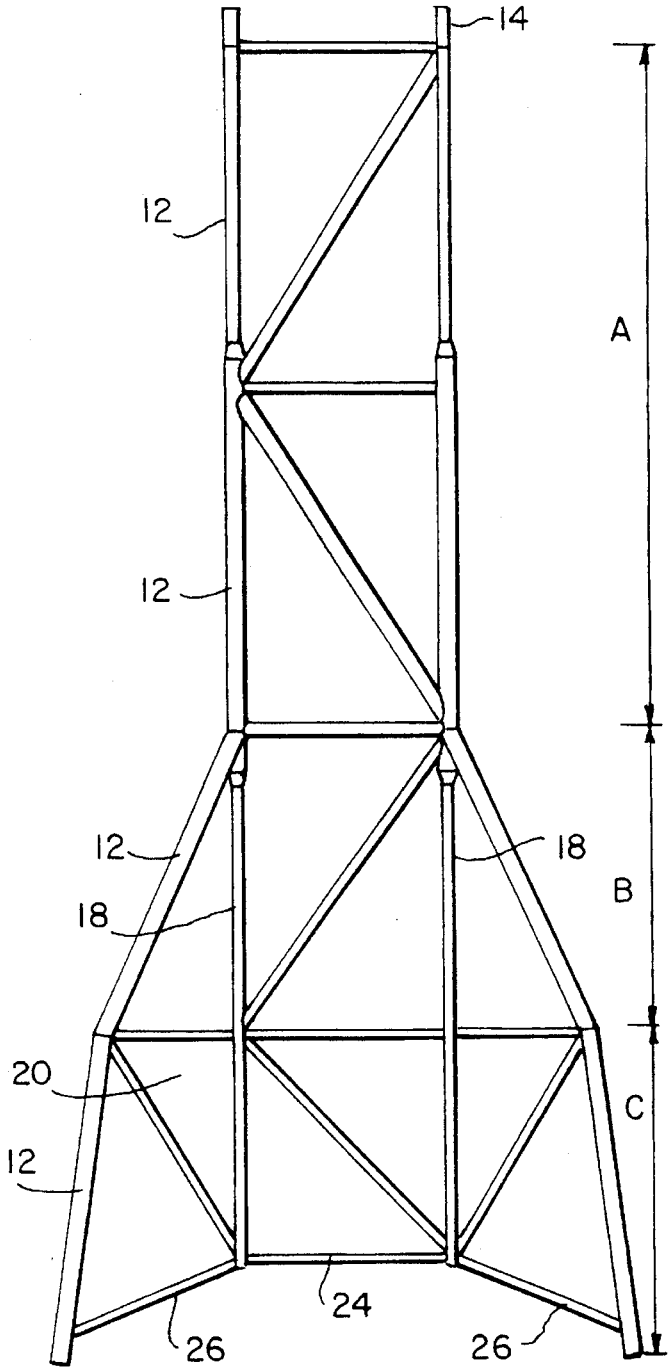
FIG. 2*a* is an elevation view of the structure's front and rear faces, where A is the upper region, B is the transition region and C is the lower region of the structure.
Figure 3B:
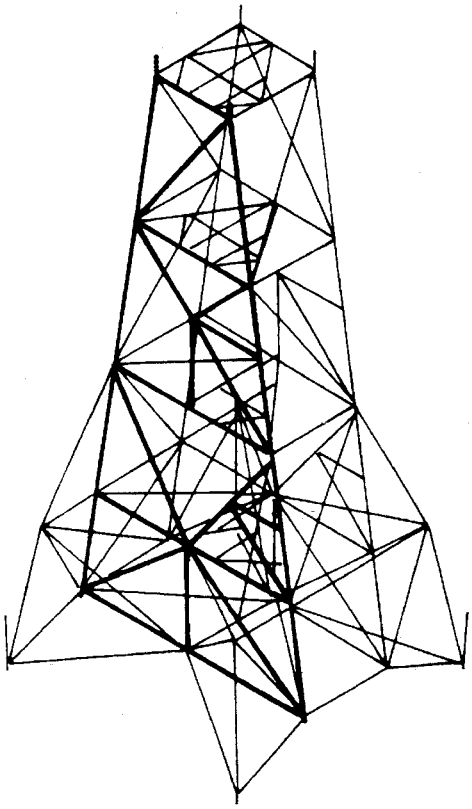
FIGS. 3*b* is a schematic view of the structure wherein the thick lines of the wire frame sketch show the location of FIG. 3*a* in the structure of the invention.
Figure 3A:
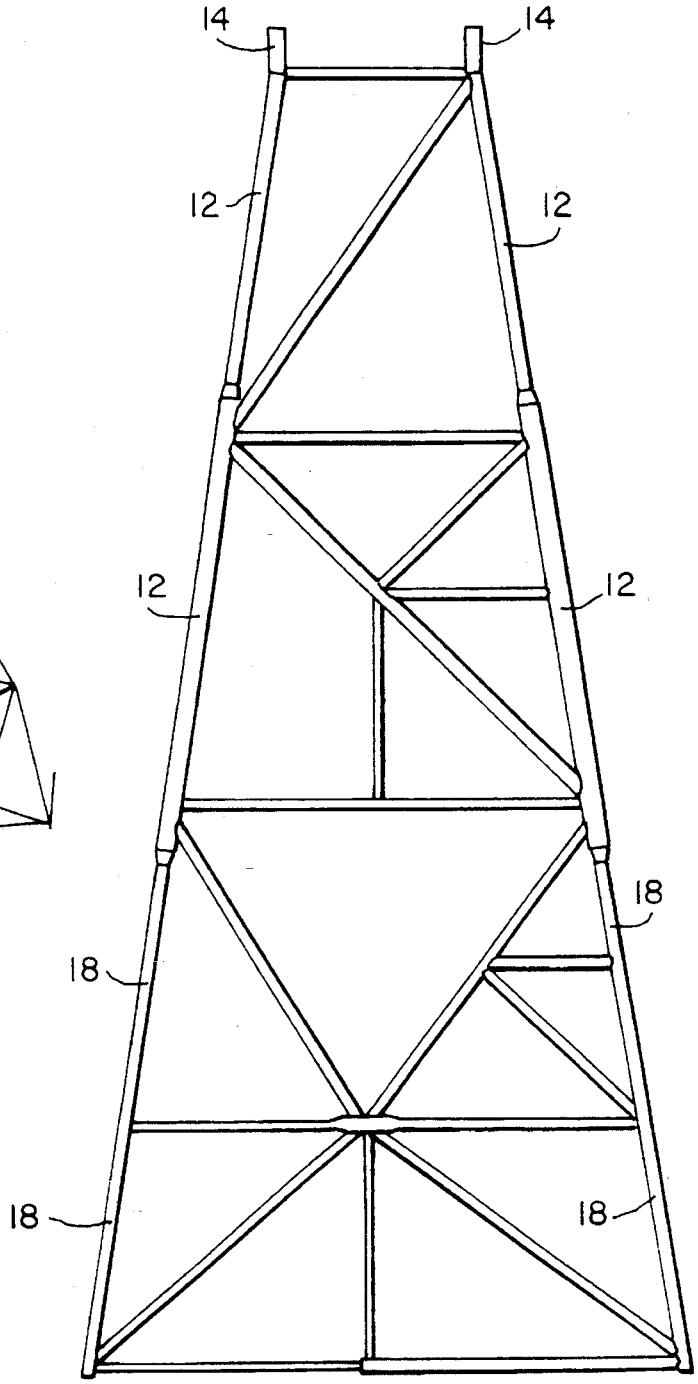
FIG. 3*a* is an elevation view of the structure's lateral faces.

As can be seen from the Figures, where the same numerical references identify corresponding parts, the structure for supporting an offshore platform, designated by the numerical reference 10, comprises four main legs 12 which slant outwardly in the lower region C and transition region B of the structure and extend parallel in the front and rear faces in the upper region A and from which extend vertical ends 14 to be adapted to the operation platform (not shown) while in the lower region C a widened base 20 is presented which is fixed to the seabed by piles or groups of vertical piles 22 fixed to the lower ends of the four main legs 12.

To allow the loading out on a barge and the launching of the structure by sliding, the main legs 12 are extended by reduced diameter ramifications or extensions referred to as secondary legs 18 which extend from the point of slanting out of the main legs 12 to the structure base; the thus formed set establishing the launch rails.

Thus the object of the present invention can be defined as a four-legged structure in its upper region A and as an eight-legged structure in its transition region B and lower region C having the combined advantages of the two aforementioned conventional concepts without their inconveniences.

Figure 4B:
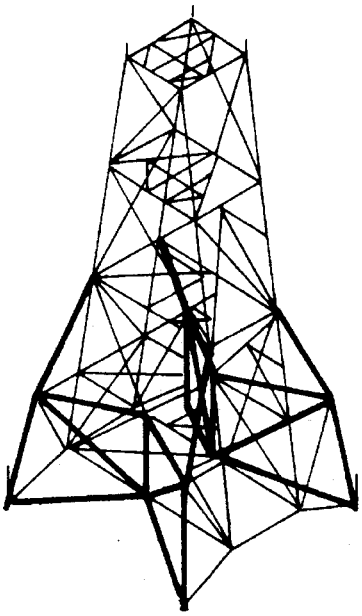
FIG. 4*b* is a schematic view of the structure wherein the thick lines of the wire frame sketch show the location of FIG. 4*a* in the structure of the invention.
Figure 4A:
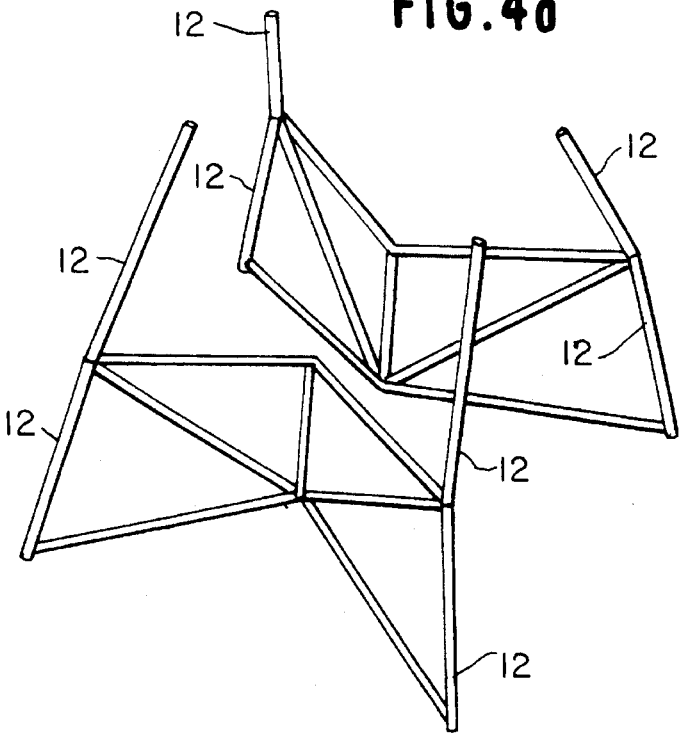
FIG. 4*a* is a perspective view of the structure's external lateral faces including a portion of the main legs situated in the widened base.
Figure 5B:
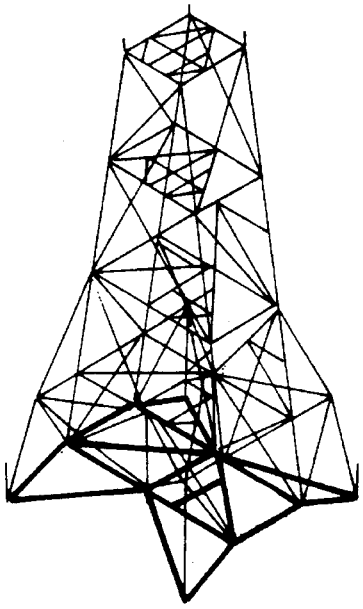
FIG. 5*b* is a schematic view of the structure wherein the thick lines of the wire frame sketch show the location of FIG. 5*a* in the structure of the invention.
Figure 5A:
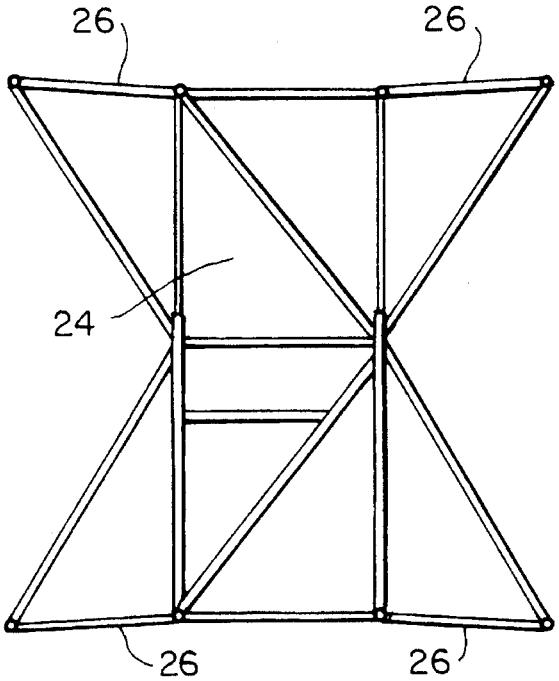
FIG. 5*a* is a plane projected view of the structure's lower horizontal bracing members.

A main feature of structure 10, as illustrated in FIGS. 4*a* and 4*b*, is that the external lateral faces of the structure located in the lower region C have a dihedral or approximately dihedral configuration thus providing a widened base, the dimensions of which can be tailored at will with a reduced number of structural elements and great structural simplicity. This simplified structural configuration is also present in the transition region B in which the only elements external to the main core are the slanting spans of the main legs.

As a consequence of the structural transparency and simplicity of the upper region A and also in regions B and C, the structure of the present invention shows reduced susceptibility to environmental loads. Besides, the widened base 20 combined to the cited lower environmental loads which confer stability and reduced loads to the foundations make the inventive structure particularly suited to sites of low strength marine soils and harsh meteo-oceanographic conditions.

A main additional feature of structure 10 is the lower horizontal bracing frame 24 being raised in relation to the sea bottom, in order to avoid interferences with the drilling template (when one exists) thus making the structure's docking operation easier while eliminating the need for expensive operations to clean up the sea bottom, normally obstructed by debris originating from drilling wells. The raised position of the lower frame 24 is made possible without the addition of any other structural members, since the vertical force transmitted by the lateral bracing members 26 is supported by the secondary legs 18. Still, as a favorable consequence, the raised position of the lower horizontal frame 24 results in a reduction i the structure's overall weight, due to the reduced length of lateral face members.

Further, the peculiar geometrical configuration of structure 10, notably in the lower region C and transition region B permits the transmission of operational and environmental loads directly to the foundations 22 through the main legs 12, thus minimizing the portion of the load transmitted by shear forces throughout the lateral panels situated between the aforementioned main legs 12 and the secondary legs 18 and consequently, optimizing also the height of lower region C and intermediary transition region B, each of those made up in this fashion of a single bay. As a consequence of the peculiar structural configuration of the aforementioned lateral panels, even the secondary legs 18, used for the installation phases, have been designed to bear the forces originating from the operation phase. Therefore, there is no need of any other main structural elements specifically dimensioned for the installation phase.

Due to its peculiar configuration and structural optimization, the structure 10, which is the object of the present invention, does not present any increase in weight based on the conventional, four-legged pyramidal frustum structure without launching trusses while presenting a reduced cross-section in the vicinity of its center of gravity. Consequently, the structure can be alternatively installed by lifting, with a reduced radius of operation of the crane boom and, consequently, maximized lifting load capacity, leading to great flexibility in the choice of the method of installation, which can thus be modified without losses after the structure's design or building, according to the availability of naval facilities.

Due to the peculiar structure configuration of the widened base and foundation the operation of driving the vertical piles 22 is made considerably easier, with the piles being situated at a comfortable distance from the structure's upper modules, minimizing the risk of impacts and the consequent damage to the structural elements, which then do not require the usual impact protection. The use of vertical piles also eliminates the need of pile guides, reducing still further the weight and the overall cost of the structure, since the elimination of pile guides also allows the pile installation in a single body, without the costly operation of offshore welding.

Also due to the structure's peculiar configuration with a widened base of low center of gravity, the forces in the rocker arms of the launching barge are minimized, since the pivoting of the structure is delayed up to the complete immersion of its upper portion, with the weight being counter-balanced by the hydrostatic buoyancy. Due to the low positioning of its center of gravity, the structure can be easily designed to be self-upended following the launching with the use of buoyancy tanks in its upper portion.

While the invention has been particularly shown and described with reference to preferred embodiments thereof, it will be understood by those in the art that the foregoing and other changes in form and details may be made therein without departing from the spirit and scope of the invention.

I claim:

1. An offshore tower having a widened base structure for supporting an offshore platform comprising four main legs each having a first cross-sectional dimension disposed at corners of a rectangle with legs in each of two pairs of legs being disposed parallel to each other to define front and rear faces in an upper region of said tower with said front and rear faces angled inwardly toward each other in an upward direction, said main legs angling outwardly in an intermediate region and a lower region for resting on a seabed, four secondary legs each having a second cross-sectional dimension smaller than said first cross-sectional dimension connected to and extending downwardly from and in alignment with said main legs in said upper region said secondary legs extending downwardly through said intermediate and lower regions for engagement with said seabed, said main legs and said secondary legs in said intermediate and lower regions defining external lateral faces having a substantially dihedral configuration whereby operational and environmental loads are directly transmitted to said seabed through said main legs.

2. An offshore tower as set forth in claim 1, wherein said main legs in said upper region and said secondary legs in said intermediate and lower regions define continuous launch rails for loading out and launching said structure from a sea going vessel.

3. An offshore tower as set forth in claim 1, wherein a lowermost horizontal bracing frame is secured between said main legs and said secondary legs at a point intermediate opposite ends of said lower region to space said lowermost horizontal bracing frame from said seabed to eliminate the need for extensive seabed preparation.

* * * * *